US005435739A

United States Patent [19]

Inaba et al.

[11] Patent Number: 5,435,739

[45] Date of Patent: Jul. 25, 1995

[54] VERTICALLY INSERTABLE-DETACHABLE CONNECTOR

[75] Inventors: Shigemitsu Inaba; Shigemi Hashizawa; Hidehiko Kuboshima, all of Shizuoka, Japan

[73] Assignee: Yazaki Corporation, Tokyo, Japan

[21] Appl. No.: 228,500

[22] Filed: Apr. 15, 1994

[30] Foreign Application Priority Data

Apr. 16, 1993 [JP] Japan ..... 5-112411

[51] Int. Cl.[6] ..... H01R 13/28

[52] U.S. Cl. ..... 439/287; 439/284; 439/291

[58] Field of Search ..... 439/287, 284, 290, 291, 439/292, 342

[56] References Cited

U.S. PATENT DOCUMENTS

| | | | |
|---|---|---|---|
| 3,646,499 | 2/1972 | De Lano et al. . | |
| 4,204,188 | 5/1980 | Weichart et al. | 439/284 X |
| 4,653,825 | 3/1987 | Olsson | 439/291 X |
| 4,963,102 | 10/1990 | Gettig et al. | 439/291 OR |
| 4,971,575 | 11/1990 | Martellotti | 439/284 X |
| 4,990,099 | 2/1991 | Marin et al. | 439/284 OR |

*Primary Examiner*—Larry I. Schwartz
*Assistant Examiner*—Daniel Wittels
*Attorney, Agent, or Firm*—Sughrue, Mion, Zinn, Macpeak & Seas

[57] ABSTRACT

A vertically insertable-detachable connector which includes male and female connectors, and can be reduced in height to provide a compact construction when the two connectors are connected together, and can easily achieve waterproof and dust-prevention effects, and can save a space required for mounting a harness. The male connector include a male terminal having a wire retaining portion and a fitting contact tongue extending in a direction perpendicular to a direction of extension of a wire, and a housing containing the male terminal therein and having a notch which is formed at a front end portion thereof, the watch opening in a direction of extension of the fitting contact tongue. The female connector includes a female terminal having a wire retaining portion and a fitting hole extending in a direction perpendicular to a direction of extension of a wire, and a housing containing the female terminal therein and having a notch which is formed at a front end portion thereof, the notch opening in a direction of the opening of the fitting hole. When the fitting contact tongue is inserted and fitted in the fitting hole, the notched front end portions of the two connectors are connected together, thereby reducing a deviation of the two wires from each other in a direction perpendicular to the axes of the two wires.

6 Claims, 4 Drawing Sheets

VERTICALLY INSERTABLE-DETACHABLE CONNECTOR

BACKGROUND OF THE INVENTION

1. Field of the invention

This invention relates to a connector that is vertically insertable and detachable.

2. Related art

In a conventional horizontally insertable-detachable connector, where wires are thick, it is difficult to bend the wires, and therefore in many cases it has been necessary for the connector to have an excessive length, and hence an operation efficiency as well as the efficiency of use of a space, has not been satisfactory.

In order to improve this, a vertically insertable-detachable connector has been proposed. For example, there is known the type of construction in which a fitting contact portion and a wire clamping portion are disposed in an L-shape, and the clamping portion is connected to one end of the contact portion.

In the vertically insertable-detachable connector of such a construction, however, the dimension of the connector in a direction of a height thereof is increased since a terminal has an L-shape defined by the fitting contact portion and the wire clamping portion. When the terminal is to be inserted in a housing, two halves of the split housing are joined together, and therefore a satisfactory waterproof function has not been obtained.

Another problem is that since the axes of the two wires do not coincide with each other when the connectors are fitted together, increased mounting space is required.

The present invention has been made in order to overcome such drawbacks and problems, and an object of the invention is to provide a vertically insertable-detachable connector which comprises male and female connectors, and can be reduced in height to provide a compact construction when the two connectors are connected together, and can easily achieve waterproof and dust-prevention effects, and can save space required for mounting a harness.

SUMMARY OF THE INVENTION

The above object of the present invention has been achieved by a vertically insertable-detachable connector comprising a male connector comprising a male terminal having a wire retaining portion and a fitting contact tongue extending in a direction perpendicular to a direction of extension of a wire, and a housing containing the male terminal therein and having a notch which is formed at a front end portion thereof, and is open in a direction of extension of the fitting contact tongue; and a female connector comprising a female terminal having a wire retaining portion and a fitting hole extending in a direction perpendicular to a direction of extension of a wire, and a housing containing the female terminal therein and having a notch which is formed at a front end portion thereof, and is open in a direction of opening of the fitting hole; wherein when the fitting contact tongue is inserted and fitted in the fitting hole, the notched front end portions of the two connectors are connected together, thereby reducing a deviation of the two wires from each other in a direction perpendicular to the axes of the two wires.

The male terminal is retained on the housing of the male connector by a stopper, and the female terminal is retained on the housing of the female connector by a stopper.

A seal wall is formed along an outer periphery of one of the housings of the male and female connectors whereas a seal is provided along an outer periphery of the other housing, whereby when the male and female connectors are fitted together, the seal wall and the seal cooperate with each other to achieve a sealing effect.

When the fitting contact tongue of the male terminal of the male connector is to be inserted and fitted in the fitting hole in the female terminal of the female connector, the housings of the male and female connectors do not impinge on each other, and can be connected together intimately, since the front end portions of the two housings are notched. As a result, space required for effecting the operation is extremely small.

The fitting contact tongue of the male terminal is disposed perpendicularly to the direction of extension of the wire, and also the fitting hole in the female terminal is disposed perpendicularly to the direction of extension of the wire. Therefore, when the fitting contact tongue is fitted in the fitting hole, the two wires extend in the same direction, and coincide with each other. As a result, a harness space, and particularly the height of the connector can be significantly reduced, and the mating of the two wires can be achieved easily.

Furthermore, when the two connectors are connected together, the seal means provided respectively on the housings of the two connectors cooperate with each other, thereby achieving a seal against moisture and dust.

BRIEF DESCRIPTION OF THE DRAWINGS

FIG. 2(*b*) is a top plan view of the male connector taken along the line X—X in FIG. 2(*a*);

FIG. 2(*c*) is an elevational view of the male connector in FIG. 2 (*a*) from an end thereof;

FIG. 5(*b*) is a bottom view of the female terminal taken along line X—X in FIG. 5(*a*);

FIG. 5(*c*) is an elevational view of the female terminal in FIG. 5(*a*) from an end thereof;

DETAILED DESCRIPTION OF THE PREFERRED EMBODIMENTS

One preferred embodiment of the present invention will now be described with reference to the drawings.

Figure 1:
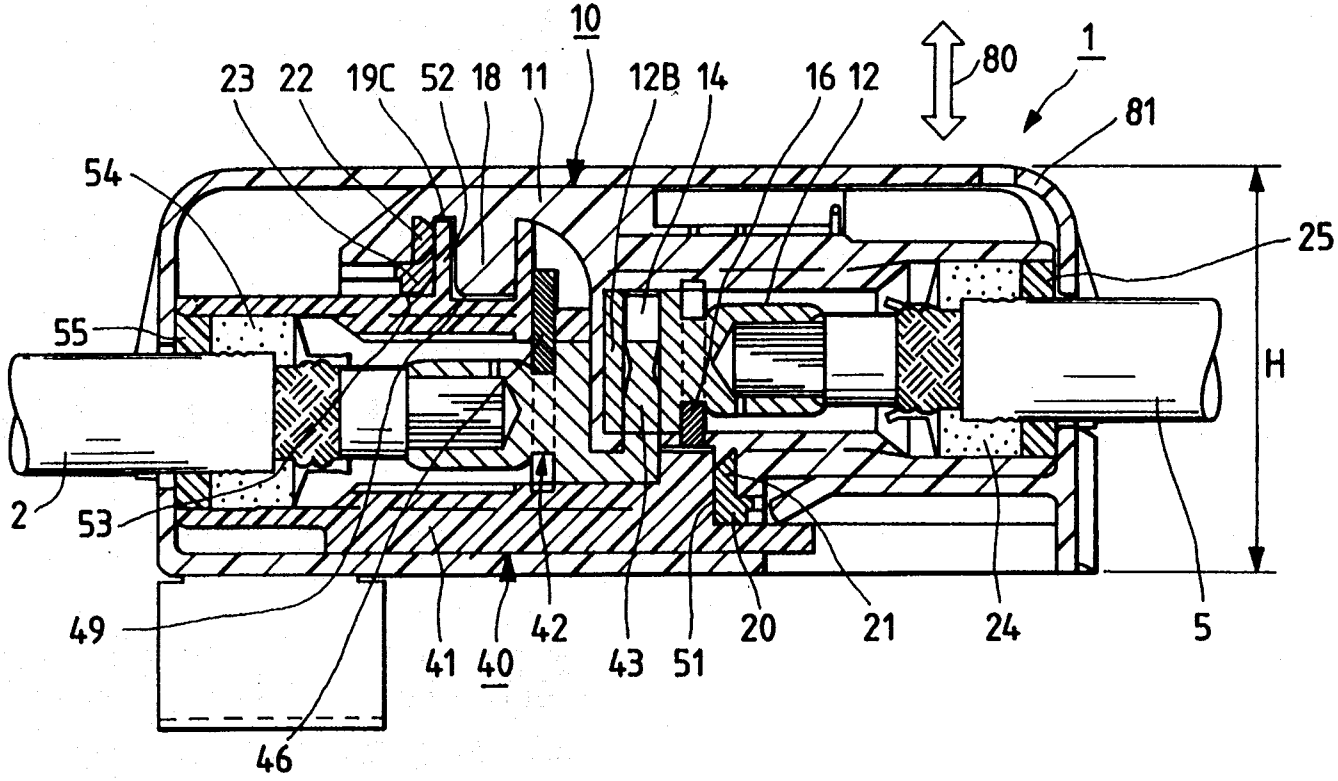
FIG. 1 a cross-sectional view of one preferred embodiment of a vertically insertable-detachable connector of the present invention.

FIG. 1 is a cross-sectional view of one preferred embodiment of a vertically insertable-detachable connector of the present invention.

In FIG. 1, the vertically insertable-detachable connector 1 of the present invention comprises a female connector 10 and a male connector 40 both of which are housed in a box 81.

The construction and assembling of the male connector 40 will first be described with reference to FIGS. 2(*a*)–2(*c*). The male connector 40 comprises a housing 41, a male terminal 42, an electrically conductive bushing 54, and a retainer 55.

The construction of the housing 41 will first be described. The housing 41 is of a generally rectangular parallelepipedic shape, and is made of an insulative synthetic resin or the like, and is of an integral construction. A wire 2 is retained in a central hollow portion of the housing 41 in a longitudinal direction, and the housing 41 has a longitudinal front end portion 59 having an upper portion thereof notched or removed. For the sake of convenience, the rectangular parallelepipedic housing 41 will be explained in terms of an upper lid 41A and a lower bottom 41B.

A seal wall 52 extends upright from a front end portion of the upper lid 41A of the housing 41, and an upwardly-open fitting space 49 is provided in this seal wall 52. A fitting extension 48 of a fork-shaped cross-section is provided in this fitting space 49. An insertion hole 57 for the passage of a stopper 46 therethrough is provided adjacent to the front side of the seal wall 52.

A seal wall 51 extends vertically downwardly from a front end portion of the lower bottom 41B of the housing 41, and a seal wall 50 extends horizontally forwardly from a lower end of the seal wall 51. A step portion 58 for retaining a fitting contact portion 42B of the male terminal 42 is also provided at the front end portion of the lower bottom 41B.

Figure 2B:
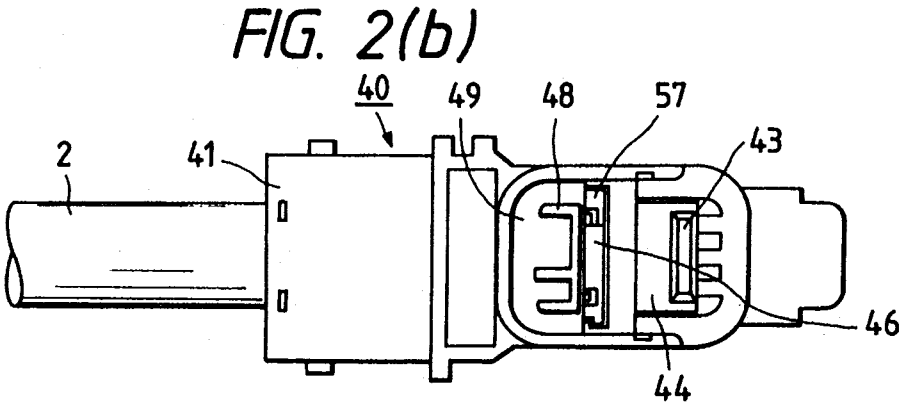
FIG. 2(*a*) is a cross-sectional view of a male connector of FIG. 1.
Figure 2C:
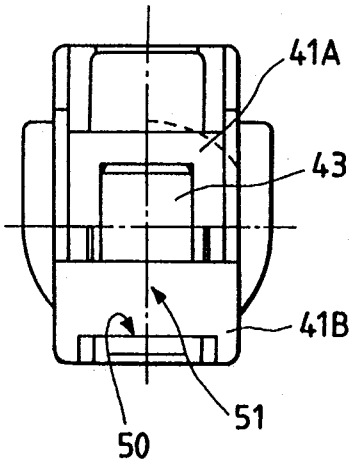
Figure 2A:
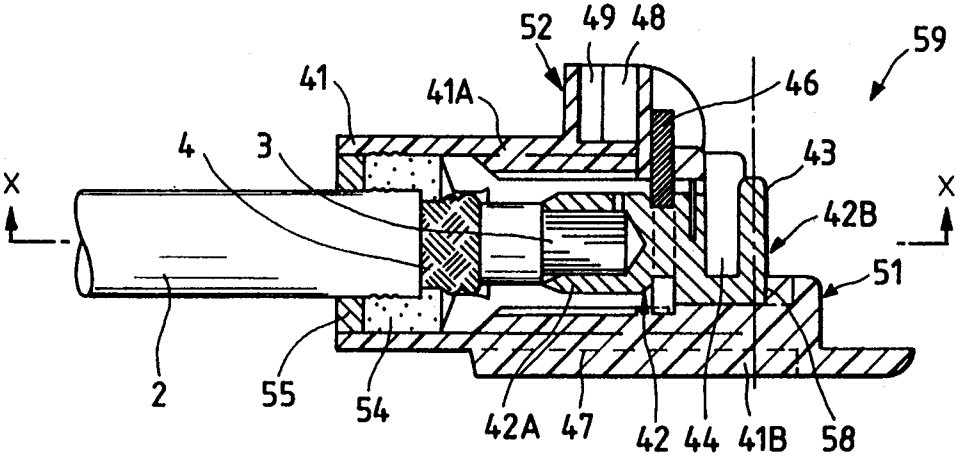
Figure 4:
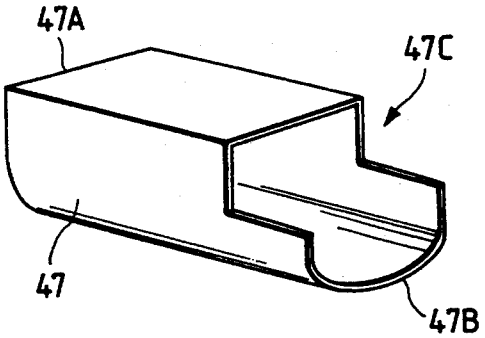
FIG. 4 is a perspective view of a shield box for the male terminal in FIG. 2 (a)

The housing 41 further comprises a metallic shield box 47, part of which is embedded in the housing 41 as shown by the dash line in FIG. 2(*a*). As shown in FIG. 4, the shield box 47 has a notch 47C provided at an upper side of a longitudinal front end portion thereof, and a large proportion of this shield box except for its rear end portion 47A is embedded in the resin housing 41 during the molding of the housing. The rear end portion 47A of the shield box 47 is in contact with the inner surface of the rear end portion of the housing 41, and is exposed at its inner surface.

Figure 3:
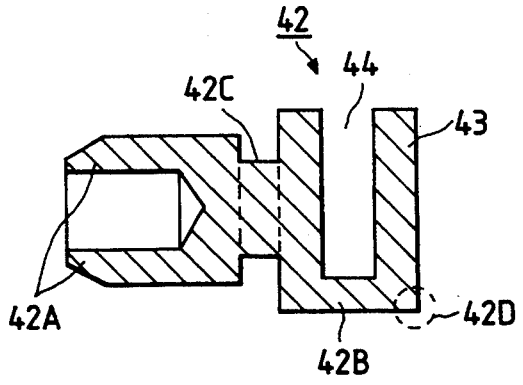
FIG. 3 is a detailed view of the male terminal of FIG. 2(*a*)

Next, the construction of the male terminal 42 will now be described with reference to FIG. 3.

The male terminal 42 is made of electrically-conductive metal, and is of an integral construction. This male terminal has at its rear end a wire retaining portion 42A for compressively clamping a copper conductor 3 to make electrical connection. The male terminal also has at its front end the fitting contact portion 42B of an upwardly-open U-shape.

The fitting contact portion 42B has a fitting contact tongue 43 extending upwardly adjacent to a fitting groove 44. A lower end of the fitting contact tongue 43 has a right-angular corner 42D.

A recess 42C for suitable abutting engagement with the stopper 46 later described is formed in a connecting portion interconnecting the wire retaining portion 42A and the fitting contact portion 42B.

The operation for connecting the wire 2 to the male terminal 42 of the above construction will now be described.

When an outer covering is peeled from the wire 2, a shield sheath 4 is exposed. When the shield sheath 4 and an inner layer inside of this shield sheath 4 are peeled, the copper conductor 3 is exposed. Here, in a condition in which the copper conductor 3 and the shield sheath 4 are exposed, the front end portion of the copper conductor 3 is inserted into the wire retaining portion 42A, and is clamped thereto by compressing this wire retaining portion. As a result, the copper conductor 3 is electrically connected to the whole of the male terminal 42.

Next, the operation for incorporating the male terminal 42, having the wire 2 connected thereto, into the housing 41 will now be described. The male terminal 42 is inserted into the housing 41 from the open rear end of this housing, and is advanced forwardly, and when the corner 42D at the lower end of the front end of the male terminal 42 is abutted against the step portion 58 on the lower bottom 41B of the housing 41, the bushing 54 is fitted in the open rear end of the housing 41 to sealingly close this rear end.

At this time, the inner periphery of the bushing 54 engages the exposed shield sheath 4 of the wire 2, and the outer periphery of this bushing engages the rear end portion of the shield box 47 exposed along the inner surface of the rear end portion of the housing 41, so that this bushing electrically connects the shield sheath 4 and the shield box 47 together. As a result of this connection, the shield box 47 performs a shield effect.

Thereafter, the retainer 55 of a plastic material is sealingly fitted in the open rear end of the housing 41.

After the above operation is finished, the stopper 46 is passed downwardly through the insertion hole 57 in the upper lid 41A of the housing 41, and is fitted at its front end in the recess 42C in the male terminal 42, thereby retaining and fixing the male terminal 42 relative to the housing 41. The stopper 46 is made of metal or a rigid resin, and the front end of this stopper has such dimensions as to be suitably abutted against and engaged in the recess 42C.

The assembling of the male connector 40 is thus completed.

Figure 5A:
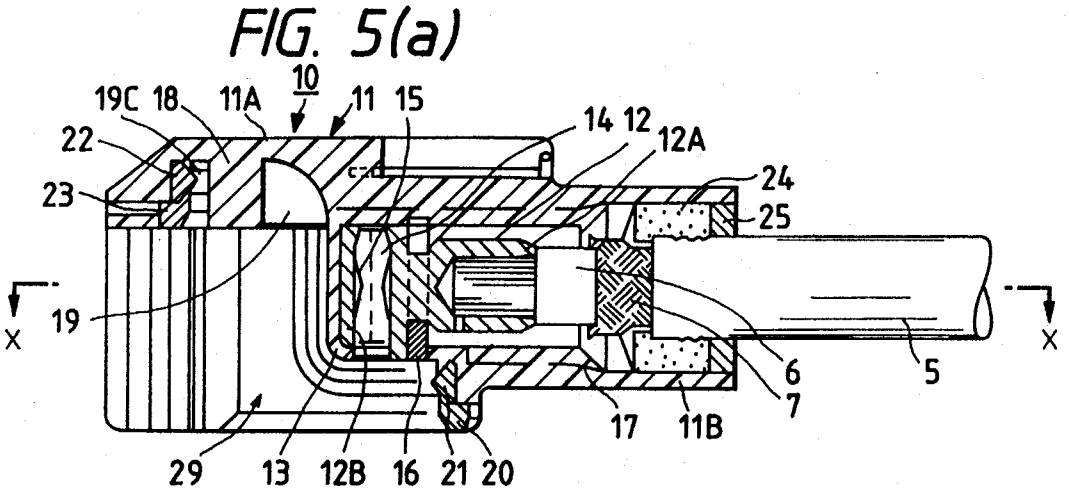
FIG. 5(*a*) is a cross-sectional view taken along the of a female terminal in FIG. 1.
Figure 5B:
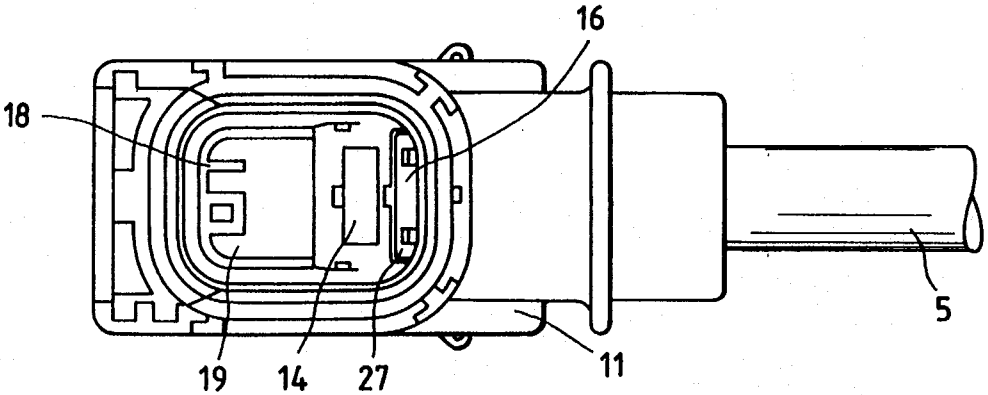
Figure 5C:
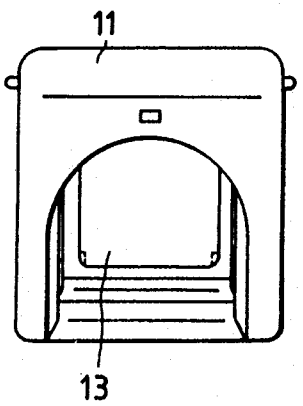

Next, the construction and assembling of the female connector 10 will now be described with reference to FIGS. 5(*a*)–5(*c*). The female connector 10 comprises a housing 11, a female terminal 12, a electrically conductive bushing 24, and a retainer 25.

First, the construction of the housing 11 will now be described. The housing 11 has a generally parallelepipedic shape, and is made of an insulative synthetic resin or the like, and is of an integral construction. A wire 5 is retained in a central hollow portion of the housing 11 in a longitudinal direction, and the housing 11 has a longitudinal front end portion 29 having a lower portion thereof notched or removed. For the sake of convenience, the rectangular parallelepipedic housing 11 will be explained in terms of an upper lid 11A and a lower bottom 11B.

A fitting space 19 is provided at the front end portion of the upper lid 11A of the housing 11, and a downwardly-extending fitting extension 18 is provided in this fitting space 19. The fitting extension 18 has a fork-shaped cross-section, and when the housing 11 and the housing 41 are fitted together, the fitting extension 18 of a resin and the fitting extension 48 of a resin having a fork-shaped cross-section are fitted together in the fitting space 49 of the housing 41.

An outer surface of the fitting extension 18 cooperates with a depending wall, formed at the front end of the upper lid 11A, to form a downwardly-open seal hole 19C. A seal 22 and a seal holder 23 are provided along the depending wall at the front end, and are disposed at an angle of 90 degrees.

A retaining wall 13 depending from the rear end of the fitting space 19 serves to retain the female terminal 12, and this retaining wall 13 and a stopper 16 cooperate with each other to retain the female terminal 12 within the housing 11.

A wall extends vertically downwardly from the front end of the lower bottom 11B of the housing 11, and a seal holder 20 and a seal 21 are provided along this downwardly-extending wall, and are disposed at an angle of 90 degrees.

An insertion hole 27 for the passage of the stopper 16 therethrough is formed in the front end portion of the lower bottom 11B.

Figure 7:
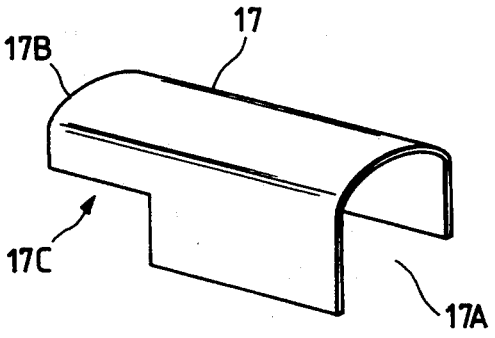
FIG. 7 is a perspective view of a shield box for the female terminal in FIG. 5(*a*).

The housing 11 further comprises a metallic shield box 17 part of which is embedded in the housing 11. As shown in FIG. 7, the shield box 17 has a notch 17C provided at a lower side of a longitudinal front end portion thereof, and a large proportion of this shield box except for its rear end portion 17A is embedded in the housing 11 of a resin during the molding of this housing. The rear end portion 17A of the shield box 47 is in contact with the inner surface of the rear end portion of the housing 11, and is exposed at its inner surface.

Figure 6:
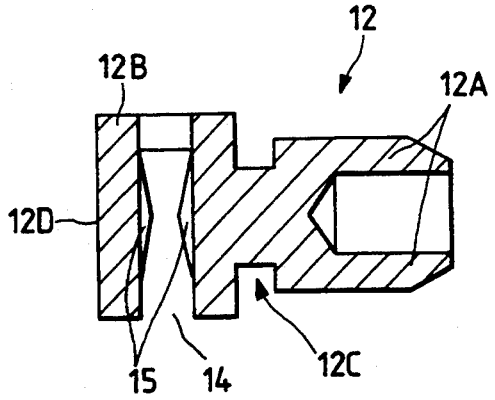
FIG. 6 is a detailed view of the female terminal of FIG. 5(*a*)

Next, the construction of the female terminal 12 will now be described with reference to FIG. 6.

The female terminal 12 is made of electrically-conductive metal, and is of an integral construction. This male terminal has at its rear end a wire retaining portion 12A for compressively clamping a copper conductor 3 to make electrical connection. The female terminal 12 also has at its front end the fitting contact portion 12B of a downwardly-open U-shape.

Electrically-conductive leaf springs 15 are provided on an inner surface of a downwardly-open fitting hole 14 in the fitting contact portion 12B. The electrically-conductive leaf springs 15 are provided in order to more positively achieve electrical connection and mechanical contact relative to the fitting contact tongue 43 to be fitted.

A recess 12C for suitable abutting engagement with the stopper 16 later described is formed in a connecting portion interconnecting the wire retaining portion 12A and the fitting contact portion 12B.

The operation for connecting the wire 5 to the female terminal 12 of the above construction will now be described.

In the wire 5, a copper conductor 6 and a shield sheath 7 are exposed, and in this condition the front end portion of the copper conductor 6 is inserted into the wire retaining portion 12A, and is clamped thereto by compressing this wire retaining portion. As a result, the copper conductor 6 is electrically connected to the whole of the female terminal 12.

Next, the operation for incorporating the female terminal 12, having the wire 5 connected thereto, into the housing 11 will now be described. The female terminal 12 is inserted into the housing 11 from the open rear end of this housing, and is advanced forwardly, and when a front wall 12D, formed at the front end of the female terminal 12, is abutted against the retaining wall 13 of the housing 11, the bushing 24 is fitted in the open rear end of the housing 11 to sealingly close this rear end.

At this time, the inner periphery of the bushing 24 engages the exposed shield sheath 7 of the wire 5, and the outer periphery of this bushing engages the rear end portion of the shield box 17 exposed along the inner surface of the rear end portion of the housing 11, so that this bushing electrically connects the shield sheath 7 and the shield box 17 together. As a result of this connection, the shield box 17 performs a shield effect.

Thereafter, the retainer 25 of a plastics material is sealingly fitted in the open rear end of the housing 11.

After the above operation is finished, the stopper 16 is passed through the insertion hole 27 in the lower bottom 11B of the housing 11, and is fitted at its front end in the recess 12C in the female terminal 12, thereby retaining and fixing the female terminal 12 relative to the housing 11. The stopper 16 is made of metal or a rigid resin, and the front end of this stopper has such dimensions as to be suitably abutted against and engaged in the recess 12C.

The assembling of the female connector 10 is thus completed.

The thus assembled male and female connectors 40 and 10, having the wires connected thereto, respectively, are connected together.

Referring back to FIG. 1, the male connector 40 and the female connector 10 are moved toward each other in a direction perpendicular to the direction of extension of the two wires 2 and 5, that is, in a connecting direction indicated by arrow 80, so that the fitting contact tongue 43 of metal is inserted and fitted in the fitting hole 14 in the metal material. At the same time, within the fitting space 49, the fitting extension 18 of a resin and the fitting extension 48 of a resin are fitted together, and the seal wall 52 of a resin is fitted in the seal hole 19C in the resin material.

Further, the seal 22 seals the seal wall 52. On the other hand, the seal 21 seals the seal wall 51.

Thus, the female connector 10 and the male connector 40 are connected together electrically and mechanically. This assembly is contained in the box 81. As is clear from FIG. 1, when the two connectors are connected together, the connector height H is very low, and the direction of the wire 2 coincides with that of the wire 5, and the two wires 2 and 5 are disposed close to each other, and therefore the mating of the two wires 2 and 5 can be easily and surely determined. Further, since the positive seal structure is provided by the seals and the bushings, excellent waterproof and dust-prevention effects can be achieved.

As described above, in the vertically insertable-detachable connector of the present invention, the fitting contact tongue of the male terminal is disposed perpendicularly to the direction of extension of the wire, and also the fitting hole in the female terminal is disposed perpendicularly to the direction of extension of the wire. Therefore, when the fitting contact tongue is fitted in the fitting hole, the two wires extend in the same direction, and coincide with each other. As a result, a harness space, and particularly the height of the connector can be significantly reduced, and the mating of the two wires, as well as the assembling, can be achieved easily. Furthermore, in the vertically insertable-detachable connector of the present invention, when the fitting contact tongue is to be inserted and fitted in the fitting hole, the two housings will not impinge on each other, and can be connected together intimately, since the front end portions of the housings of the male and female connectors are notched. As a result, a space required for effecting the operation can be extremely small.

Furthermore, when the two connectors are connected together, the seal means provided respectively on the housings of the two connectors cooperate with each other, thereby achieving a seal against moisture and dust.

What is claimed is:

1. A vertically insertable-detachable connector comprising:

a male connector (40) including:

a male terminal (42) having a wire retaining portion (42A) for retaining a bared end of a wire (2) and a fitting contact tongue (43) extending in a direction substantially perpendicular to a direction of extension of the wire retaining portion (42A) and the bared end of the wire (2);

a housing (41) containing the male terminal (42) therein and having a fitting space (49) formed at a front end portion thereof, the fitting space (49) opening in a direction of extension of the fitting contact tongue (43);

a female connector (10) including:

a female terminal (12) having a wire retaining portion (12A) for retaining a bared end of a wire (5) and a fitting hole (14) extending in a direction substantially perpendicular to a direction of extension of the wire retaining portion (12A) and the bared end of the wire (5), the fitting contact tongue (43) being received in the fitting hole (14); and a housing (11) containing the female terminal (12) therein and having a fitting extension (18) which is formed at a front end portion thereof, the fitting extension (18) extending in a direction of extension of the fitting hole (14) and being received in the fitting space (49).

2. A vertically insertable-detachable connector as recited in claim 1, wherein the fitting contact tongue (43), the fitting hole (14), the fitting space (49) and the fitting extension (18) are disposed so that when the fitting contact tongue (43) is inserted in the fitting hole (14), the fitting extension (18) is received in the fitting space (49), thereby aligning the wires (2), (5) along longitudinal axes of the wires (2), (5).

3. A vertically insertable-detachable connector as recited in claim 1, further comprising:

a first stopper (46) for retaining the male terminal (42) in the housing (41) of the male connector (40); and a second stopper (16) for retaining the female terminal (12) in the housing (11) of the female connector (10).

4. A vertically insertable-detachable connector as recited in claim 1, further comprising:

a first electrically conductive bushing (54) fitted in an open rear end of the housing (41) of the male connector (40) to sealingly close the open rear end of the housing (41) of the male connector (40); and a second electrically conductive bushing (24) fitted in an open rear end of the housing (11) of the female connector (10) to sealingly close the open rear end of the housing (11) of the female connector (10).

5. A vertically insertable-detachable connector as recited in claim 1, further comprising:

a seal wall (51), (52) formed along an outer periphery of one of the housings (11), (41) of the male and female connectors (40), (10); and a seal (21), (22) provided along an outer periphery of the other housing (11), (41), whereby when the male and female connectors (40), (10) are fitted together, the seal wall (51), (52) and the seal (21), (22) cooperate with each other to achieve a sealing effect.

6. A vertically insertable-detachable connector as recited in claim 4, further comprising:

a metallic shield box (17), (47) partially embedded in each housing (11), (41) and electrically connected to a shield sheath (7), (4) of each of the wires (2), (5) via said first and second electrically conductive bushings (24), (54), respectively.

* * * * *